US005955246A

United States Patent [19]

Thomas

[11] Patent Number: 5,955,246

[45] Date of Patent: Sep. 21, 1999

[54] METHOD OF PROCESSING A SILVER HALIDE PHOTOGRAPHIC PRODUCT

[75] Inventor: Françoise Marie Thomas, Chalon-Sur-Saone, France

[73] Assignee: Eastman Kodak Company, Rochester, N.Y.

[21] Appl. No.: 09/128,869

[22] Filed: Aug. 4, 1998

[30] Foreign Application Priority Data

Aug. 4, 1997 [FR] France ..... 97 10169

[51] Int. Cl.[6] ..... G03C 5/29

[52] U.S. Cl. ..... 430/405; 430/264; 430/448; 430/487; 430/493

[58] Field of Search ..... 430/405, 448, 430/487, 493

[56] References Cited

U.S. PATENT DOCUMENTS

| | | | |
|---|---|---|---|
| 4,997,743 | 3/1991 | Sasaoka et al. | 430/264 |
| 5,432,042 | 7/1995 | Deprez et al. | 430/204 |
| 5,652,088 | 7/1997 | Yamashita et al. | 430/448 |
| 5,789,144 | 8/1998 | Thomas | 430/405 |
| 5,834,169 | 11/1998 | Thomas | 430/405 |

FOREIGN PATENT DOCUMENTS

| | | |
|---|---|---|
| 0 616 254 A1 | 3/1993 | European Pat. Off. . |
| 0 628 878 A1 | 12/1994 | European Pat. Off. . |

OTHER PUBLICATIONS

Photographic Product for Black and White Photography Adapted to Non poluting Development and Process Therefor by Gehin. Research Disclosure, vol. 173, No. 064, Sep. 10, 1978.

*Primary Examiner*—Hoa Van Le
*Attorney, Agent, or Firm*—J. Lanny Tucker

[57] ABSTRACT

The present invention concerns a novel method of developing a silver halide photographic product by the surface application of a developing solution. The photographic product comprises an incorporated developing agent in an amount of 0.5 mol/mol of silver, or less. The applied developing solution comprises an alkanolamine (at least 0.6 mol/l), a solution miscible wetting agent, and a developing agent.

14 Claims, 2 Drawing Sheets

METHOD OF PROCESSING A SILVER HALIDE PHOTOGRAPHIC PRODUCT

FIELD OF THE INVENTION

The present invention is directed to a method for developing a silver halide photographic product, and to a photographic product having a developing agent incorporated in reduced quantities.

BACKGROUND OF THE INVENTION

Conventionally, processing a black and white photographic product comprises a development step, a fixing step and a washing step. The processing of color photographic products comprises a color development step, a bleaching step, a fixing step and a washing step. These processing steps are generally implemented in processing tanks in which the photographic product is contacted with the processing solutions.

With tank processing, the processing solutions lose their effectiveness and become loaded with contaminating compounds that leach out of the photographic product itself or are carried over from adjacent processing solutions. The result is a reduction in efficacy of the photographic solutions, which requires the use of replenishing solutions. In particular, the developers that transform the latent image into a silver image by reducing the silver ions, become loaded with halide ions coming from the photographic film. The halide ions, in a high concentration in the developing solution, greatly slow down the efficacy of the developer.

The conventional technique of processing in tanks makes it necessary to use large quantities of solution. In addition, the destruction or recycling of these large volumes of solution gives rise to many problems, in particular with respect to environmental protection. These problems are all the greater since the standards for discharging chemical solutions are becoming more and more severe.

In order to limit the problems related to the use of a large volume of processing solution, it would be advantageous to have a method of developing a photographic product by the surface application of a developing solution.

The technique of development by surface application of a layer of developing solution makes it possible to reduce considerably the volume of processing solution useful for the development, and consequently all the problems of recovery, recycling or destruction. However, the known methods which use this technique present drawbacks. They require, for example, additional processing steps which are often complex, such as for example the conditioning of the developing solution. In addition, these methods have not made it possible to obtain satisfactory sensitometric results.

SUMMARY OF THE INVENTION

The present invention solves the noted problems with a method for developing a silver halide photographic product comprising an incorporated developing agent in a quantity less than or equal to 0.5 mol/mol of silver to be developed, the method comprising applying to the photographic product, a layer of a developing solution containing, in aqueous solution, an alkanolamine in a quantity greater than or equal to 0.6 mol/l, a quaternary ammonium salt, at least one wetting agent stable at a high pH and miscible in the developing solution, and a developing agent capable of reducing the silver ions.

This invention also provides a silver halide photographic product comprising a developing agent chosen from hydroquinone and/or one of its derivatives in a quantity less than or equal to 0.5 mol/mol of silver to be developed.

DETAILED DESCRIPTION OF THE INVENTION

Figure 1A:
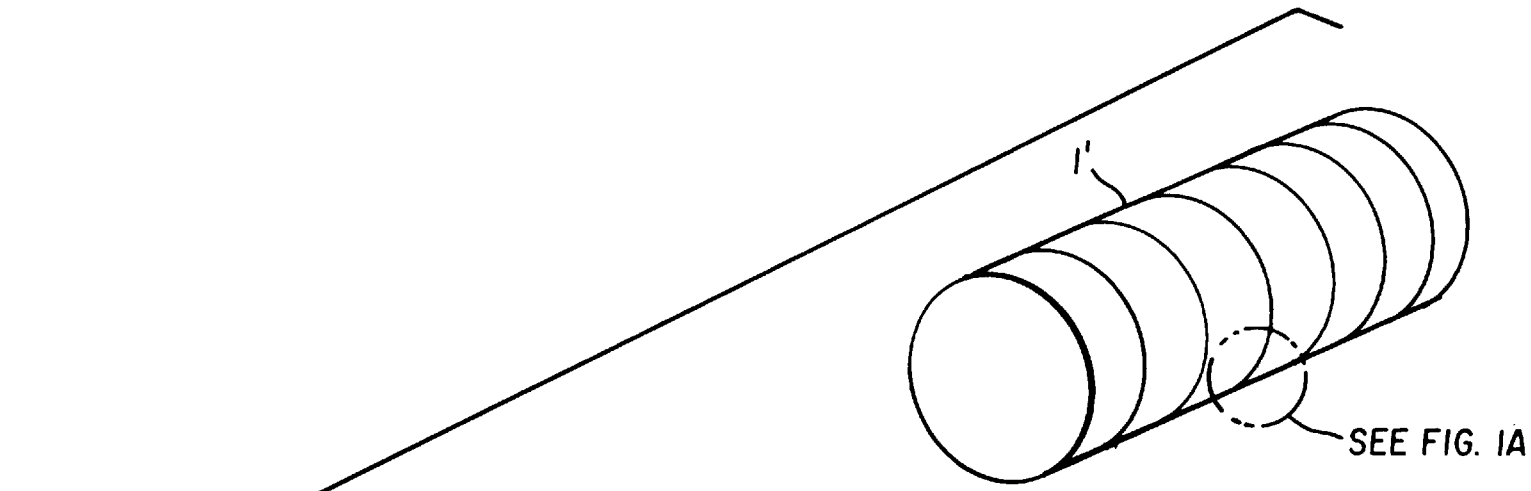
FIGS. 1 and 2 are schematic illustrations of devices allowing surface application of the developing solution.
Figure 1A:
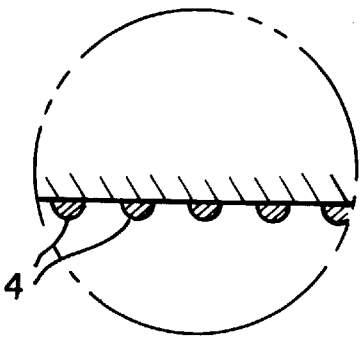

The method of this invention makes it possible to develop photographic products rapidly with a very small volume of developing solution. It makes it possible to process, in particular, high-contrast photographic products, for example photographic products useful in the graphic arts.

In addition, this method avoids the problems of contamination or reduction in efficacy of the development bath.

In the context of the present invention, the development method eliminates the sensitometric variations due to the use of used or seasoned baths. This is because the present invention makes it possible to develop photographic products with a developing solution that is never seasoned since this solution, applied in a layer to the photographic product, is used only once. This method eliminates the need to use replenishing solutions.

In addition, the application of the developing solution as a layer greatly reduces the volumes of solution required for the development of the photographic product. In this way the problems of recycling and destruction of photographic effluents are limited, as well as sensitometric variations related to the stirring of the developing baths.

This method reduces the ecological impact of the developing baths by virtue of the low volume of developing solution used. In addition, through an appropriate choice, the present method can be implemented with solutions that do not contain hydroquinone. It also makes it possible to reduce the quantities of chemical product used, in particular the quantities of developing agents.

In addition, the use of photographic products containing a quantity of incorporated developing agent less than the quantity required for developing the total quantity of silver contained in the product improves, in a surprising fashion, the stability over time and the physical properties such as the hardness of the photographic product.

The present invention is a method of development by surface application, that is to say the photographic product is not immersed in a tank filled with developing solution, but its face opposite the support is covered with a layer of the developing solution of the present invention.

According to the invention, it is possible to develop very satisfactorily photographic products exposed with a volume of processing solution of between 20 and 200 ml/m$^2$, and preferably between 20 and 50 ml/m$^2$, of photographic product to be developed. With such a method, use is made of a volume of developing solution up to 20 times less than that used with conventional tank processing methods. The viscosity of the aqueous developing solution is about the viscosity of water (about 1 cp, 20° C.). The aqueous developing solution does not contain any thickening agent.

The application of the developing solution in a layer can be effected by any known means which makes it possible to apply an aqueous solution uniformly to a flat support in order to form a layer. This application can be effected manually or automatically.

Figure 1:
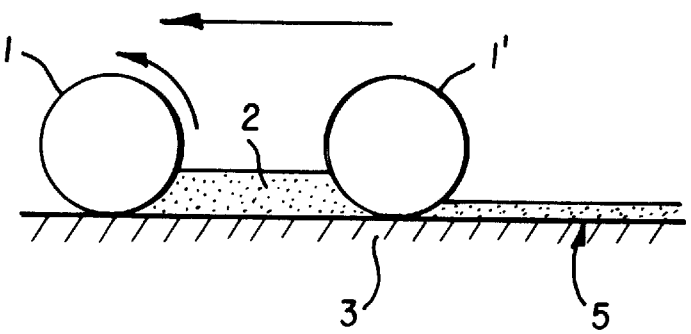

According to one embodiment, the developing solution is applied by means of the device described in FIG. 1, which comprises two rollers 1, 1' connected together and forming a reservoir containing the developing solution 2 to be spread, the whole being placed on surface 5 of the film 3 to be developed. The leading roller 1 can be covered with a flexible rubber, and the rear roller 1' can be a roller with a ribbed surface 4 which controls the spreading of the layer of developing solution. The device (not visible in the FIG.) is equipped with means for automatically moving the device over the film, which makes it possible to deposit a uniform layer of developing solution on the film.

Figure 2:
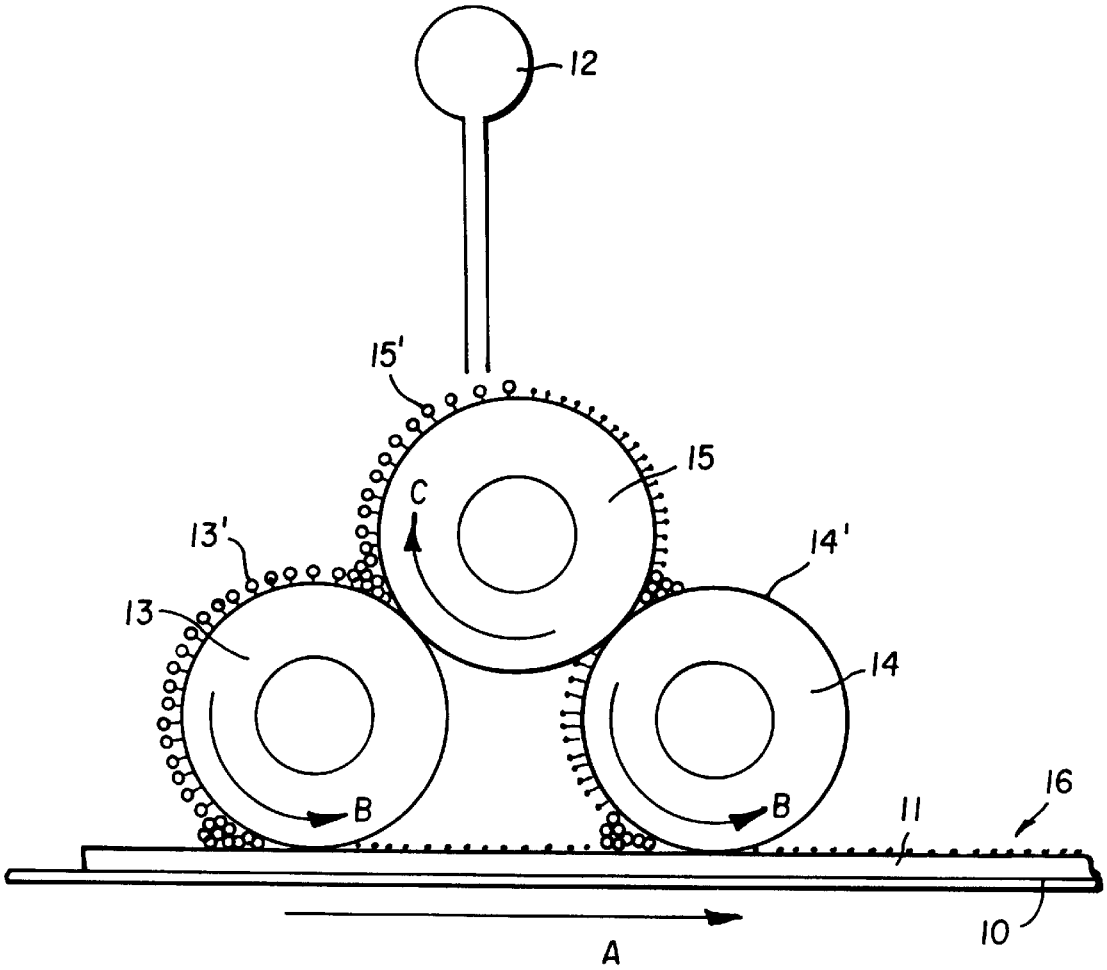

According to another embodiment, the developing solution is applied by means of the device described in the patent application GB 2,306,017. This device, described in FIG. 2, comprises a surface 10 which supports the photographic product to be developed 11, a means of conveying the photographic product, which does not appear in the figure, a reservoir 12 which delivers a given quantity of developing solution, a means for applying the developing solution which comprises at least two bottom rollers 13 and 14 in contact with the photographic product to be developed, and a top roller 15 situated above each of the two bottom rollers 13 and 14, the top roller 15 being in contact with the bottom rollers 13 and 14. The developing solution is deposited on the surface 15' of the roller 15 and then flows over the surfaces 13' and 14' of the bottom rollers 13 and 14. When the photographic product is moved in the direction of the arrow A, the bottom rollers 13 and 14 are rotated as indicated by the arrows B and C, which causes the top roller 15 to rotate. This rotation makes it possible to deposit a layer 16 of developing solution on the product to be developed 11, as shown in FIG. 2.

The developing agents which can be used in the developing solution are conventional developing agents used alone or in a mixture, and soluble in a basic medium, for example aminophenols, polyhydroxybenzenes, such as paradihydroxybenzenes (for example hydroquinone or hydroquinone derivatives), 3-pyrazolidinones, pyrogallol, pyrocatechol, ascorbic acid, and others readily apparent to one skilled in the art.

In the context of the present invention, the quantities of developing agent is at least 0.02 mol/l, preferably between 0.02 mol/l and 1 mol/l, and more preferably between 0.03 mol/l and 0.6 mo/l.

However, since the required quantity of developing agent is related to the silver content in the photographic product to be processed, it is possible to envisage the use of a greater quantity of developing agent.

According to one embodiment, the developing agent is hydroquinone and/or a hydroquinone derivative, for example methylhydroquinone, hydroquinone monosulphonate, etc. In the remainder of the description, when the term "hydroquinone" is used, reference is being made to hydroquinone or one of its derivatives.

According to another embodiment, the developing agent is ascorbic acid or one of its derivatives. The ascorbic acid derivatives are for example L-ascorbic acid, D-isoascorbic acid, D-glucoascorbic acid, 6-desoxy-L-ascorbic acid, ascorbic acid in the form of a salt such as sodium ascorbate, sodium erythorbate, etc. In the remainder of the description, when the term "ascorbic acid" is used, reference is being made to ascorbic acid or one of its derivatives.

According to a different embodiment, the developing solution contains a mixture of hydroquinone and ascorbic acid. Such a mixture makes it possible to reduce the quantity of hydroquinone necessary for obtaining satisfactory sensitometric results. In this particular embodiment, the molar ratio between hydroquinone and ascorbic acid can vary to a large extent. According to the ratio used, one particular sensitometric characteristic can surprisingly be favored. In particular, when hydroquinone is in a majority in the mixture, the speed of the film is increased substantially. For ecological reasons, it is preferable to use a mixture in which ascorbic acid is in a majority. According to a particular embodiment, the hydroquinone/ascorbic acid molar ratio lies between 3:1 and 0.5:1, preferably 1:1.

It is often useful to use, in combination with the main developing agent, a co-developer which, in association with the main developing agent, produces a synergy effect on the development. The quantity of this co-developer is in general very much less than the quantity of main developing agent. The ratio by weight between the developing agent and the co-developer is generally between 3:1 and 500:1, preferably between 50:1 and 250:1.

The co-developers most often used are 3-pyrazolidinone compounds, for example the alkyl-3-pyrazolidinones, the aryl-3-pyrazolidinones, for example 1-aryl-3-pyrazolidinone, 1-phenyl-3-pyrazolidinone (known as phenidone), substituted phenidones, 4-methyl-4-hydroxymethyl phenidone, 1-phenyl-4-methyl pyrazolidinone or 1-phenyl-5-methyl-3-pyrazolidinone. The co-developers most often used are Dimezone S, phenidone and Elon.

When a co-developer is used, it can be introduced into the developing composition and/or into the photographic product to be developed.

When the developing agent is ascorbic acid, it is necessary to use a co-developer.

The developing solution of the present solution can comprise an alkanolamine, that is to say a primary, secondary or tertiary amine comprising a linear or branched hydroxyalkyl group comprising 1 to 10 carbon atoms. The alkanolamine can be chosen from amongst monoethanolamine, diethanolamine, 2-alkylethanolamine, 2-methylethanolamine, 2-ethylethanolamine, diethyl-N-N-aminoethanol, 3-aminopropanol, 2-amino-1-propanol, 4-amino-1-butanol, 2-amino-1-butanol, 3-diethyl- 1-amino-1-propanol, 1-dimethylanmino-2-propanol, 2-dimethylaminoethanol, N-ethyldiethanolamine, N-phenyldiethanolamine, triethanolamine, etc. These alkanolamines can be used in a mixture.

According to one embodiment, the alkanolamine concentration is between 0.6 and 2.0 mol/l, preferably between 0.8 and 1.5 mol/l. The developing solution of the invention is a highly basic homogenous aqueous solution. The pH of the developing solution must be greater than 10. The alkanolamine being a buffer substance (around 12), a pH higher than 12 requires the use of large quantities of alkanolamine. When it is desired to use a developing solution with a pH above 13, it is preferable to add a small quantity of strong base (for example KOH) to the developing solution instead of adding a large quantity of alkanolamine. For ecological reasons, it is however preferable to use a developing solution with a pH less than or equal to 13.

According to the present invention, the developing solution comprises at least one wetting agent which makes it possible to obtain a stable homogenous solution. In the context of the present invention, wetting agent refers to a surfactant which facilitates the spreading of the developing solution on the film and which promotes chemical exchanges between the developing solution and the photographic product to be developed. This wetting agent facilitates the penetration and diffusion of the chemical substances of the developing solution towards the silver halide photographic product. It must be photographically inert.

This wetting agent makes it possible to obtain a uniform layer of developing solution on the photographic product to be developed. It must be miscible in the developing solution, that is to say it must form a homogenous solution with the other compounds present in the developing solution. It must be stable over time in a highly basic medium. This is because the developing solution must be storable without losing its development or spreading properties. By way of example, these wetting agents can be anionic, cationic, non-ionic or amphoteric surfactants, alone or in a mixture. Representative surfactants are for example Zonyl FSN® or Alkanol XCR® manufactured by Dupont, Lodyne S-100® manufactured by Ciba-Geigy or Olin 10G® manufactured by Olin Mathieson.

It is very important in the context of the present invention to obtain a layer of developing solution which is uniform over the entire surface of the film to be processed, without missing any areas.

According to the method of the present invention, the developing solution contains quaternary ammonium salts. These quaternary salts are depicted by the following formula:

(I)

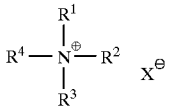

in which $R^1$, $R^2$, $R^3$ and $R^4$ are each independently hydrogen, an alkyl group with 1 to 4 carbon atoms, or an aromatic group that is carbocyclic one or more nitrogen atoms or the groups $R^1$ and $R^2$, or $R^1$, $R^2$ and $R^3$ can also represent the atoms or bonds necessary to form an aromatic or non aromatic ring with 5 to 6 atoms in the ring.

$X^-$ is an anion that balances the charge of the molecule. $X^-$ can for example be a halide or a sulphonate.

According to the invention, the quantity of quaternary ammonium salt is between 0.1 and 20 g/l, and preferably between 1 and 10 g/l.

These quaternary ammonium salts can be for example, 1-phenethyl-2-methyl pyridinium bromide, 2-phenethyl-1-pyridinium bromide, 1-phenethyl-2-pyridinium bromide, 2,6-dichlorobenzyl-1-pyridinium bromide, benzyltriethyl ammonium chloride, tetrabutylammonium perchlorate, 1,4-dimethylpyridinium p-toluene sulphonate, 1-methyl-2-propynyl-2-pyridinium bromide, or tetrapropyl ammonium chloride.

According to a preferred embodiment, the quaternary ammonium salt is a salt of formula (I) in which at least one of the groups $R^1$, $R^2$ and $R^3$ is an aryl group. According to another preferred embodiment, the quaternary ammonium salt is a salt of formula (I) in which $R^1$, $R^2$ and $R^3$ represent the atoms necessary for forming a pyridinium ring. According to one embodiment of the invention, the ammonium salt is 1-phenethyl-2-methyll pyridinium. In the scope of the present invention, the wetting agent differs from the quaternary ammonium salt.

According to a particular embodiment of the present invention, the developing solution is in the form of a kit comprising two solutions, a first solution containing the developing agent or agents in aqueous solution, the pH of this solution making it possible to keep the effective quantity of developing agent dissolved, and a second solution containing the other components of the developing solution. The ready-to-use developing solution of the invention is obtained by mixing the two solutions described previously. It may then be necessary to adjust the pH.

According to one embodiment, the developing solution comprises an alkanolamine in a quantity from 0.6 mol/l to 2.0 mol/l; 0.1 to 20 g/l of a quaternary ammonium salt; 0.1 to 3% by developing solution volume of at least one wetting agent stable at a high pH and miscible in the developing solution, and at least 0.02 mol/l of ascorbic acid.

The developing solution of the present invention may contain other compounds such as for example antifog agents, preservatives, bacteriocides, fungicides, sequestering agents or buffer compounds. Examples of these compounds are described in *Research Disclosure*, Sep. 1994, 365, No. 36544 (hereinafter referred to as *Research Disclosure*), Section XIX. In the context of the invention, it is particularly advantageous to use a developing solution which contains 5-nitroindazole as an antifog agent.

The photographic products used in the development method of the present invention are silver halide photographic products having an incorporated developing agent in a quantity less than or equal to 0.5 mol/mol of silver to be developed, preferably less than 0.4 mol/mol of silver to be developed, and more preferably between 0.4 and 0.05 mol/mol of silver to be developed.

The developing agents which can be incorporated in the photographic product are polyhydroxybenzene developers which are conventional in photography, for example hydroquinone or hydroquinone derivatives, 3-pyrazolidinones, pyrogallol, pyrocatechol, ascorbic acid, and others known in the art.

According to a particular embodiment, the incorporated developing agent is hydroquinone and/or a hydroquinone derivative, for example tert-butylhydroquinone, methylhydroquinone, hydroquinone monosulphonate, and others known in the art.

The developing agent can be incorporated in any layer of the photographic product. However, it is preferable not to incorporate the developing agent in the halide emulsion layer in order to avoid unwanted reactions of this developing agent with the silver halides, before or after exposure. According to a particular embodiment, the developing agent is incorporated in a layer adjacent to the silver halide emulsion layer, and this layer can be situated between the support and the silver halide emulsion layer or on top of the emulsion layer.

When the co-developer is introduced into the photographic product, it is preferably present in the layer containing the developing agent.

According to a preferred embodiment, the method of the invention comprises the surface application of a developing solution containing ascorbic acid or one of its derivatives as a developing agent on a silver halide photographic product comprising, as an incorporated developing agent, hydroquinone in a quantity less than or equal to 0.5 mouinol of silver to be developed, preferably less than 0.4 mol/mol of silver to be developed, and more preferably in a quantity between 0.4 and 0.05 mol/mol of silver to be developed.

According to a particular embodiment, the co-developer is present in the photographic product containing hydroquinone.

This particular embodiment has the advantage of using a developing solution which does not contain ascorbic acid.

The photographic products which can be developed with the solution of the present invention can contain any type of photographic emulsion. For example, these examples can comprise three-dimensional, cubic, tabular, or other types of silver halide grains.

According to a preferred embodiment, the photographic product which is processed with the solution of the present invention contains silver halide emulsions containing at 50 mol % chloride based on silver, with the remaining halides can be bromide, iodide or a mixture thereof.

In the context of the present invention, the emulsions can be pure silver chloride, silver chlorobromide, silver chlorobromoiodide, silver chloroiodobromide or silver chloroiodide emulsions. When reference is made to silver halide grains or silver halide emulsions containing at least two silver halides, the halides are cited in decreasing order of concentration.

Although the silver halide grains can be saturated with iodide (around 40 mol %), it is preferable to limit the iodide to less than 20 mol %, preferably less than 10 mol %, based on silver. Very small quantities of iodide are generally sufficient to increase the sensitivity of the emulsion.

In the context of the present invention, any type of silver halide photographic product can be processed with the developing solution of the present invention. It is for example possible to process positive-working or negative-working photographic products, black and white photographic products, reversal photographic products, etc.

The present invention is described in more detail in the following examples.

EXAMPLE 1

The photographic product used in this example comprised an ESTAR® ethylene polyterephthalate support covered with a gelatin underlayer (1.8 g/m$^2$) containing the hydrazine nucleating agent of formula (I) (0.006 g/m$^2$), the incorporated amino booster of formula (II) (0.05 g/m$^2$), a latex (0.4 g/m$^2$) and a bisvinylmethylsulfone agent (3.5% by weight based on the total dry gelatin).

The underlayer was covered with a silver halide emulsion layer, itself covered with a protective top layer of gelatin (0.8 g/m$^2$).

The silver halide emulsion was a cubic grain emulsion (0.1 $\mu$m edge) of silver chlorobromide (70 mol % chloride), silver content: 1.8 g/m$^2$, gelatin content: 1.3 g/m$^2$.

In the underlayer of the photographic product, a developing agent (methylhydroquinone: 0.36 g/m$^2$, i.e. 0.0029 mole/m$^2$) and a co-developer (HMMP: 0.1 g/m$^2$) were incorporated.

In this way a photographic product was obtained containing a quantity of developing agent of around 0.175 mol/mol of silver to be developed.

Pr being n-propyl.

The photographic product described above was exposed through a sensitometric wedge with 18 levels (increments of 0.1) with a xenon flash exposure meter for two microseconds through a Wratten 29 filter.

The exposed film was developed by applying to this film a layer of developing solution having the following composition at room temperature, in a quantity of around 20 ml/m$^2$:

Composition of the developing solution

| | Concentration |
|---|---|
| 2-methyl-amino ethanol | 70 g/l (0.9 mol/l) pH = 12 |
| 5-nitroindazole | 0.2 g/l |
| KBr | 5 g/l |
| $K_2SO_3$ | 99 g/l |
| PEPB* | 2 g/l |
| OLIN 10G ® wetting agent | 30 cc/l |
| Developing agent | See Tables 1 |

*PEPB: 1-phenethyl-2-methylpyridinium bromide

The developing solution was applied by means of the device described in FIG. 1.

In this way a layer of developing solution was formed which made it possible to develop the film.

The device was then moved in the opposite direction in order to eliminate the excess developing solution. In this embodiment, the developing solution remained in contact with the film for 20 seconds.

The film was then placed in a stop bath (30 seconds), a fixing bath (1 min at 25° C.), followed by a washing bath.

By reading with a densitometer, a sensitometric curve was obtained from which the following sensitometric parameters were determined:

Dmin (density of the support+fog)

Dmax (point of maximum density)

Effective contrast (EC) (slope of the sensitometric curve measured between a density of 0.1 and 2.5)

Toe contrast (TC) of the sensitometric curve (slope of the sensitometric curve measured between a density of 0.1 and 0.6).

Speed (S) (sensitivity of the film measured at a density of 2 above the Dmin)

The comparative example 1.8 was carried out with a film having the structure described above but which contained neither developing agent nor co-developer, the co-developer being introduced into the developing solution.

The sensitometric results are set out in the following tables.

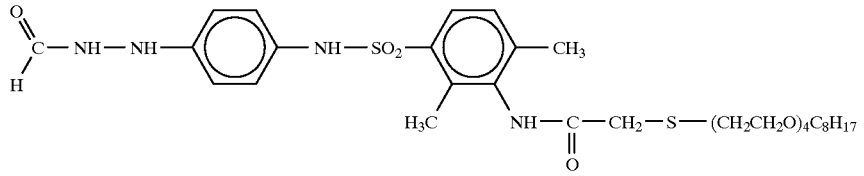

(I)

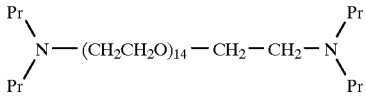

(II)

TABLE 1a

| | Ex. 1.1 0 g/l AA | Ex. 1.2 24 g/l AA | Ex. 1.3 48 g/l AA | Ex. 1.4 72 g/l AA | Ex. 1.5 96 g/l AA |
|---|---|---|---|---|---|
| Dmax | 2.6 | 3.732 | 3.908 | 4.073 | 3.898 |
| S | 357 | 376 | 376 | 376 | 372 |
| TC | 5.9 | 12.8 | 10.7 | 9.2 | 8.2 |
| EC | 2.8 | 19.1 | 19 | 18.6 | 16.3 |

TABLE 1b

| | Ex. 1.6 15 g/l HQ | Ex. 1.7 12 g/l AA + 7.5 g/l HQ | Ex. 1.8 48 g/l AA 1.5 g/l HMMP |
|---|---|---|---|
| Dmax | 3.8 | 3.9 | 3.6 |
| S | 384 | 379 | 365 |
| TC | 71 | 8.0 | 5.3 |
| EC | 17.5 | 15.8 | 9.9 |

AA: Ascorbic Acid (main developing agent)
HQ: Hydroquinone (main developing agent)
HMMP: 4-hydroxymethyl-4-methyl-1-phenyl-3-pyrazolidinone (co-developer)

Example 1.1 shows that, when the developing solution does not contain any ascorbic acid, the sensitometric results obtained are not satisfactory. Examples 1.2 to 1.7 show that the sensitometric properties obtained with the method of the present invention are entirely satisfactory.

These examples also show that, when the film contains methylhydroquinone as the developing agent and the developing solution contains ascorbic acid, particularly satisfactory sensitometric results are obtained. In this particular embodiment, it is advantageous to manipulate developing solutions which contain neither hydroquinone nor co-developer.

EXAMPLE 2

In this example, a photographic product as described in Example 1 was used, which comprised a cubic grain emulsion (0.2 $\mu$m edge) of silver chlorobromide (70 mol % chloride) silver content: 2.5 g/m$^2$. This product comprised methyl hydroquinone (0.56 g/m$^2$ i.e. 0.0045 mole/m$^2$) as incorporated developing agent, and 4-hydroxymethyl-4-methyl-1-phenyl-3-pyrazolidinone HMMP (0.1 g/m$^2$) as co-developer.

In this way a photographic product was obtained containing a quantity of developing agent of around 0.195 mol/mol of silver to be developed.

This product was developed and processed as previously described with the developing solution of Example 1.

The sensitometric results are set out in Table 2 below.

TABLE 2

| | Ex. 2.1 0 g/l AA | Ex. 2.2 6 g/l AA | Ex. 2.3 12 g/l AA | Ex. 2.4 24 g/l AA | Ex. 2.5 48 g/l AA |
|---|---|---|---|---|---|
| Dmax | 3.026 | 3.462 | 3.915 | 4.321 | 4.559 |
| S | 343 | 357 | 364 | 367 | 369 |
| TC | 5.8 | 7.3 | 8.5 | 8.8 | 9.2 |
| EC | 4.4 | 7.8 | 12.5 | 17.2 | 18.0 |

AA: ascorbic acid (main developing agent)

These results show that good sensitometric results are obtained with developing solutions containing a quantity of ascorbic acid of around 6 g/l and above.

EXAMPLE 3

The photographic product used in this example comprised an ESTARX® ethylene polyterephthalate support covered with a gelatin underlayer (1.8 g/m$^2$) containing a mixture of developing agents comprising tert-butylhydroquinone (TBHQ: 0.388 g/m$^2$ i.e. 0.0023 mol/m$^2$) and hydroquinone (HQ: 0.258 g/m$^2$ i.e. 0.00234 mol/mol of silver to be developed), the co-developer (4-methyl-4-hydroxymethylphenidone, 0.1 g/m$^2$), a hardening agent (bisvinylmethylsulfone, 3.5% by weight based on total dry gelatin). This underlayer was covered with a layer of silver halide emulsion, itself covered with a protective top layer of gelatin (0.8 g/m$^2$).

The silver halide emulsion comprised cubic grains (0.2 $\mu$m edge) of silver chlorobromide (70 mol % chloride). The grains were chemically sensitized. They were red chromatized with a spectral sensitizer having a maximum absorption of 630 nm.

The silver content of the layer of emulsion was 3.0 g/m$^2$, the gelatin content 2 g/m$^2$.

In this way a photographic product was obtained containing a quantity of developing agent of around 0.166 mol/mol of silver to be developed.

This product was developed and processed as previously described with a developing solution having the following composition:

| | Concentration |
|---|---|
| 2-methyl amino ethanol | 70 g/l (0.9 mol/l) pH = 12 |
| 5-nitroindazole | 0.3 g/l |
| KBr | 5 g/l |
| $K_2SO_3$ | 99 g/l |
| PEPB | 5 g/l |
| OLIN 10G ® wetting agent | 30 cc/l |
| Developing agent | See Table 3 |

The sensitometric results are set out in Table 3 below.

TABLE 3

| | Ex. 3.1 24 g/l AA | Ex. 3.2 48 g/l AA | Ex. 3.3 72 g/l AA | Ex. 3.4 96 g/l AA | Ex. 3.5 30 g/l HQ | Ex. 3.6 24 g/l AA + 15 g/lHQ | Ex. 3.7 RA2000 ® Tank |
|---|---|---|---|---|---|---|---|
| Dmax | 5.0 | 5.2 | 5.2 | 5.4 | 5.3 | 5.2 | 4.9 |
| S | 349 | 348 | 349 | 348 | 356 | 347 | 347 |
| TC | 2.6 | 2.5 | 2.5 | 2.4 | 3.2 | 2.5 | 2.1 |
| EC | 7.5 | 7.0 | 6.7 | 6.4 | 8.4 | 7.3 | 5.1 |

The comparative example 3.7 was obtained with a film having the structure described above, the film being developed in a conventional fashion in tanks with the Kodak RA2000® (1+2) developing solution containing hydroquinone as a developing agent (75 g/l).

These results show that, with a conventional photographic product, satisfactory sensitometric results are obtained by surface application of the solution of the present invention. In particular, an effective contrast greater than 5 is obtained which is perfectly compatible with use for graphic arts.

EXAMPLE 4

In this example, films were used having the structure of Example 1 in which the quantity of incorporated methyihydroquinone (MeHQ) was varied (see Table 4). The films were then stored at 50° C., in an atmosphere with 50% humidity for 48 hours. The remaining quantity of methylhydroquinone in the film after storage was then measured. The variations in the quantity of methylhydroquinone are set out in the following table.

TABLE 4

| | Initial quantity of MeHQ (mg/dm$^2$) | Quantity of MeHQ after storage (mg/dm$^2$) | % of MeHQ remaining |
|---|---|---|---|
| Ex. 4.1 | 5.0 | 4.7 | 93.75 |
| Ex. 4.2 | 8.2 | 6.9 | 84.95 |
| Ex. 4.3 | 10.9 | 7.9 | 72.16 |

These examples show that the reduction in the quantity of developing agent incorporated in the photographic product improves the stability of the photographic product.

EXAMPLE 5

In this example, an enzymolysis was performed on the films of Example 4. This enzymolysis consisted of introducing the film into a bath of proteolytic enzyme (4 g/l) at pH 7, 4° C. The films were soaked in this solution at a constant speed, removed from the bath and then immersed in a solution of sulfuric acid in order to stop the attack. A measurement was then made of the length of film which was not attacked by the enzymes. This length was characteristic of the resistance of the layer and therefore of its hardness.

The following results were obtained:

TABLE 5

| | Initial quantity of MeHQ (mg/dm$^2$) | Length remaining after enzymolysis |
|---|---|---|
| Ex. 4.1 | 5.0 | 187 |
| Ex. 4.2 | 8.2 | 142 |
| Ex. 4.3 | 10.9 | 108 |

These results show that the reduction in the quantity of developing agent in the film improves the physical properties thereof.

The invention has been described in detail with particular reference to certain preferred embodiments thereof, but it will be understood that variations and modifications can be effected within the spirit and scope of the invention.

I claim:

1. A method for developing a silver halide photographic product comprising an incorporated developing agent in a quantity less than or equal to 0.5 mol/mol of silver to be developed, said method comprising applying to said photographic product, a layer of a developing solution containing, in aqueous solution, an alkanolamine in a quantity greater than or equal to 0.6 mol/l, at least one wetting agent stable at a high pH and miscible in said developing solution, a developing agent capable of reducing silver ions, and a quaternary ammonium salt having the formula (I)

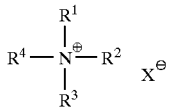

wherein $R^1$, $R^2$, $R^3$ and $R^4$ are each independently hydrogen, an alkyl group of 1 to 4 carbon atoms, or an aromatic group that is carbocyclic or heterocyclic having 1 or more nitrogen atoms, or $R^1$ and $R^2$, or $R^1$, $R^2$ and $R^3$ can represent the atoms or bonds necessary to form a ring, aromatic or not, having five to six atoms in the ring and X is an anion.

2. The method of claim 1 wherein said developing solution comprises from 0.1 to 20 g/l of said quaternary ammonium salt, from 0.1 to 3% by volume of said developing solution, of said wetting agent, and at least 0.02 mol/l of said developing agent.

3. The method of claim 1 wherein a co-developer is present either in said photographic product or in said developing solution.

4. The method of claim 3 wherein said developing solution comprises a 1-aryl-3-pyrazolidinone compound as a co-developer.

5. The method of claim 1 wherein said developing solution comprises one or more quaternary ammonium salts at from 1 to 10 g/l total; concentration.

6. The method of claim 1 wherein $R^1$, $R^2$ and $R^3$ represent the atoms necessary for forming a pyridinium ring.

7. The method of claim 6 wherein said quaternary ammonium salt is a salt of 1-phenethyl-2-methylpyridinium.

8. The method of claim 1 wherein said alkanolamine is monoethanolamnine, diethanolamine or 2-alkylethanolamnine.

9. The method of claim 8 wherein said alkanolamine is 2-methyl-aminoethanol.

10. The method of claim 1 wherein said developing solution further comprises a 5-nitroindazole.

11. The method of claim 1 wherein said developing solution is applied at from 20 ml/m$^2$ to 200 ml/m$^2$ of photographic product.

12. The method of claim 1 wherein said photographic product comprises a silver halide emulsion containing at least 50 mol % of silver chloride.

13. The method of claim 1 wherein said incorporated developing agent is hydroquinone or a derivative thereof and said developing agent contained in said developing solution is ascorbic acid or a derivative thereof.

14. The method of claim 13 wherein said incorporated developing agent is present in said photographic product in an amount of from 0.4 to 0.05 mol/mol of silver to be developed.

* * * * *